US008069753B2

(12) United States Patent
Kriz et al.

(10) Patent No.: US 8,069,753 B2
(45) Date of Patent: Dec. 6, 2011

(54) ROTARY RATCHET WRENCH

(75) Inventors: Anthony Kriz, Lone Tree, CO (US); Brent Christopher, Portland, OR (US); Mark Holtan, Centennial, CO (US)

(73) Assignee: Meridian International Co., Ltd. (JP)

( * ) Notice: Subject to any disclaimer, the term of this patent is extended or adjusted under 35 U.S.C. 154(b) by 0 days.

(21) Appl. No.: 12/617,200

(22) Filed: Nov. 12, 2009

(65) Prior Publication Data

US 2011/0017024 A1 Jan. 27, 2011

(51) Int. Cl.
*B25B 13/46* (2006.01)
*B25B 13/06* (2006.01)

(52) U.S. Cl. ..... 81/60; 81/124.5

(58) Field of Classification Search ..... 81/60, 124.3, 81/125.1, 124.4, 124.5, 177.7, 177.8, 177.9
See application file for complete search history.

(56) References Cited

U.S. PATENT DOCUMENTS

| | | | | | |
|---|---|---|---|---|---|
| 65,550 | A | | 6/1867 | Dunlan | |
| 278,053 | A | | 5/1883 | Shipherd | |
| 842,039 | A | * | 1/1907 | Walt | 81/124.3 |
| 0,915,446 | A | | 3/1909 | Kearnes | |
| D53,597 | S | * | 7/1919 | Marcmann | 81/124.4 |
| D57,323 | S | | 3/1921 | Evans | |
| 1,431,064 | A | | 10/1922 | Treisch | |
| 1,453,607 | A | * | 5/1923 | Saucier | 81/60 |
| 1,571,148 | A | | 1/1926 | Sisolak | |
| 1,796,083 | A | | 3/1931 | Carlberg | |
| 1,811,137 | A | * | 6/1931 | Kress | 81/124.3 |
| 2,028,561 | A | | 1/1936 | Pilger | |
| 2,500,835 | A | | 3/1950 | Lang | |
| 2,628,522 | A | | 2/1953 | Kraft | |
| 2,712,258 | A | | 7/1955 | Keith | |
| 2,751,802 | A | | 6/1956 | Reuillard | |
| 2,769,360 | A | | 11/1956 | Cottrell | |
| 2,951,405 | A | | 9/1960 | Engquist | |
| D224,677 | S | | 8/1972 | Lehnhard | |
| 4,748,875 | A | | 6/1988 | Lang | |
| D299,206 | S | | 1/1989 | Krapowicz | |
| 4,901,608 | A | | 2/1990 | Shieh | |
| 4,916,987 | A | | 4/1990 | Le Duc | |
| 5,119,701 | A | | 6/1992 | Wei | |
| D332,730 | S | | 1/1993 | Usuda | |
| 5,199,335 | A | | 4/1993 | Arnold et al. | |
| 5,325,744 | A | * | 7/1994 | Horikawa | 81/63.2 |

(Continued)

FOREIGN PATENT DOCUMENTS

| | | |
|---|---|---|
| DE | 1136950 | 9/1962 |

(Continued)

OTHER PUBLICATIONS

Snap-On, Wrench, Ratcheting Box, 25° Offset, Product Webpage.

(Continued)

*Primary Examiner* — Hadi Shakeri
(74) *Attorney, Agent, or Firm* — Jason R. Sytsma; Shuttleworth & Ingersoll, PLC

(57) ABSTRACT

A hand tool is disclosed. The hand tool has a gripping portion and a distal end with an attachment end disposed thereon. A ratcheting mechanism is combined with the attachment end to provide ratcheting action. A rotatable head is combined with the attachment end and engaged with the ratcheting mechanism. The rotatable head comprises a plurality of sockets and in some embodiments the rotatable head has four sockets of different size spaced thereon.

32 Claims, 3 Drawing Sheets

U.S. PATENT DOCUMENTS

| | | | | |
|---|---|---|---|---|
| 5,568,751 | A | 10/1996 | Lee | |
| 5,636,557 | A | 6/1997 | Ma | |
| 5,768,960 | A | 6/1998 | Archuleta | |
| 5,848,561 | A | 12/1998 | Hsieh | |
| 6,000,302 | A | 12/1999 | Chiang | |
| 6,050,165 | A | 4/2000 | Hall | |
| 6,134,990 | A | 10/2000 | Ling et al. | |
| 6,253,646 | B1 * | 7/2001 | Chang | 81/60 |
| 6,282,992 | B1 | 9/2001 | Hu | |
| 6,295,898 | B1 | 10/2001 | Hsieh | |
| 6,405,621 | B1 | 6/2002 | Krivec et al. | |
| 6,453,779 | B2 | 9/2002 | Hu | |
| 6,626,067 | B1 | 9/2003 | Iwinski et al. | |
| 6,629,477 | B2 | 10/2003 | Ling et al. | |
| 6,722,234 | B2 | 4/2004 | Hu | |
| D492,556 | S | 7/2004 | Barry et al. | |
| 6,769,330 | B2 | 8/2004 | Chang | |
| 6,862,956 | B1 | 3/2005 | Chen | |
| 6,868,759 | B2 | 3/2005 | Tuan-Mu | |
| D506,373 | S | 6/2005 | Hsien | |
| 6,918,323 | B2 | 7/2005 | Arnold et al. | |
| 6,971,286 | B2 | 12/2005 | Hu | |
| 7,032,478 | B2 | 4/2006 | Hu | |
| 7,082,860 | B2 | 8/2006 | Shu-Sui et al. | |
| 7,185,566 | B2 | 3/2007 | Arnold et al. | |
| 7,231,851 | B2 | 6/2007 | Tuan-Mu | |
| 7,237,460 | B2 | 7/2007 | Hu | |
| 7,246,543 | B1 * | 7/2007 | Patti | 81/124.5 |
| D551,525 | S | 9/2007 | Desbrunes | |
| 7,267,033 | B1 | 9/2007 | Lai | |
| 7,281,452 | B2 * | 10/2007 | Chang | 81/60 |
| 7,299,720 | B1 | 11/2007 | Schultz et al. | |
| 7,311,022 | B2 | 12/2007 | Putney et al. | |
| 7,318,366 | B2 | 1/2008 | Lee et al. | |
| 7,424,839 | B2 * | 9/2008 | Chiang | 81/177.8 |
| 7,444,902 | B1 | 11/2008 | Lin et al. | |
| 7,444,904 | B2 | 11/2008 | Huang | |
| 7,478,577 | B1 | 1/2009 | Wheeler | |
| 7,523,688 | B2 | 4/2009 | Putney et al. | |
| D601,871 | S | 10/2009 | Murray | |
| 2005/0178247 | A1 | 8/2005 | Arnold et al. | |
| 2007/0044600 | A1 | 3/2007 | Chen | |
| 2007/0107560 | A1 | 5/2007 | Chiang | |

FOREIGN PATENT DOCUMENTS

| | | |
|---|---|---|
| DE | 2231385 | 1/1974 |
| DE | 202004000843 | 4/2004 |
| EP | 0079440 | 5/1983 |
| FR | 630775 | 12/1927 |

OTHER PUBLICATIONS

Sears, Craftsman Dog Bone SAE Wrench, Webpage—Product Description.
Gearwrench, Roto Ratchet, Product Webpage.
Skil, Photo of Swivel Head Ratchet.
Photo of swivel head ratcheting wrench of unknown origin.
European Search Report dated Feb. 17, 2011 from related foreign application.

* cited by examiner

ROTARY RATCHET WRENCH

BACKGROUND

The instant invention relates generally to wrenches and more specifically it relates to a ratcheting box wrench having multiple sockets.

Numerous wrenches have been provided in prior art that are hand held tools for gripping, turning or twisting objects such as nuts or bolts. While these units may be suitable for the particular purpose to which they address, they would not be as suitable for the purposes of the present invention as heretofore described.

SUMMARY

A hand tool is disclosed. The hand tool has a gripping portion and a distal end with an attachment end disposed thereon. A ratcheting mechanism is combined with the attachment end to provide ratcheting action. A rotatable head is combined with the attachment end and engaged with the ratcheting mechanism. The rotatable head comprises a plurality of sockets and in some embodiments the rotatable head has four sockets of different size spaced thereon.

As previously stated, the ratcheting mechanism is combined with the attachment end. An inner circumference with an annular groove extending therearound is formed in the attachment end. A chamber extends from the attachment end into the handle. A gear ring of the ratcheting mechanism is disposed in the annular groove and engaged with a ratchet tooth disposed in the chamber.

In one embodiment, the attachment end is a box end and has a substantially circular outline. The rotatable head is substantially ball shaped and has an imaginary line on the sockets surface extending therearound about which is disposed four sockets equidistance apart.

In yet another embodiment, a second attachment end is disposed at the other distal end of the handle. A ratcheting mechanism is provided in the attachment end. A rotatable head combined with the second attachment end engages the ratcheting mechanism.

FIGURES

For a more complete understanding of particular embodiments and their features and advantages, reference is now made to the following description, taken in conjunction with the accompanying drawings, in which.

DETAILED DESCRIPTION

Figure 1:
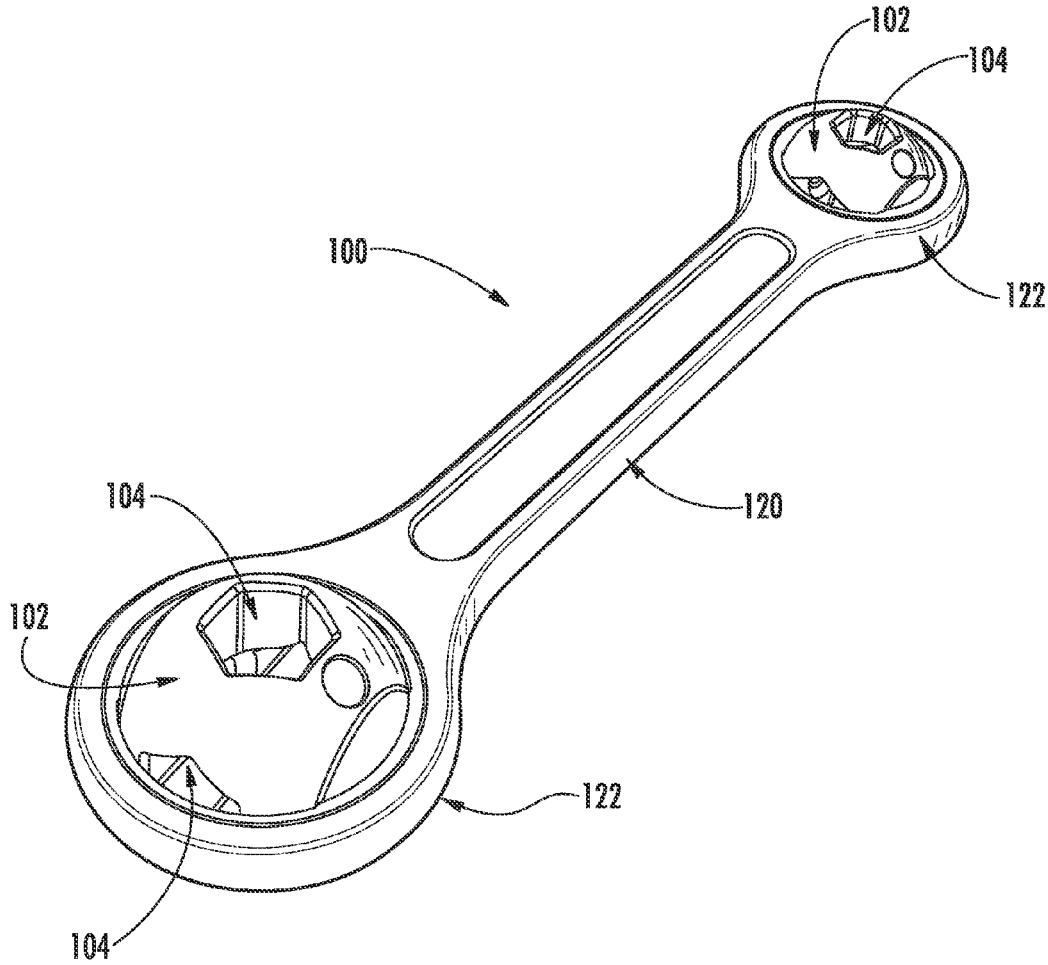
FIG. 1 is a perspective view of a preferred embodiment of the rotary ratchet wrench.
Figure 2:
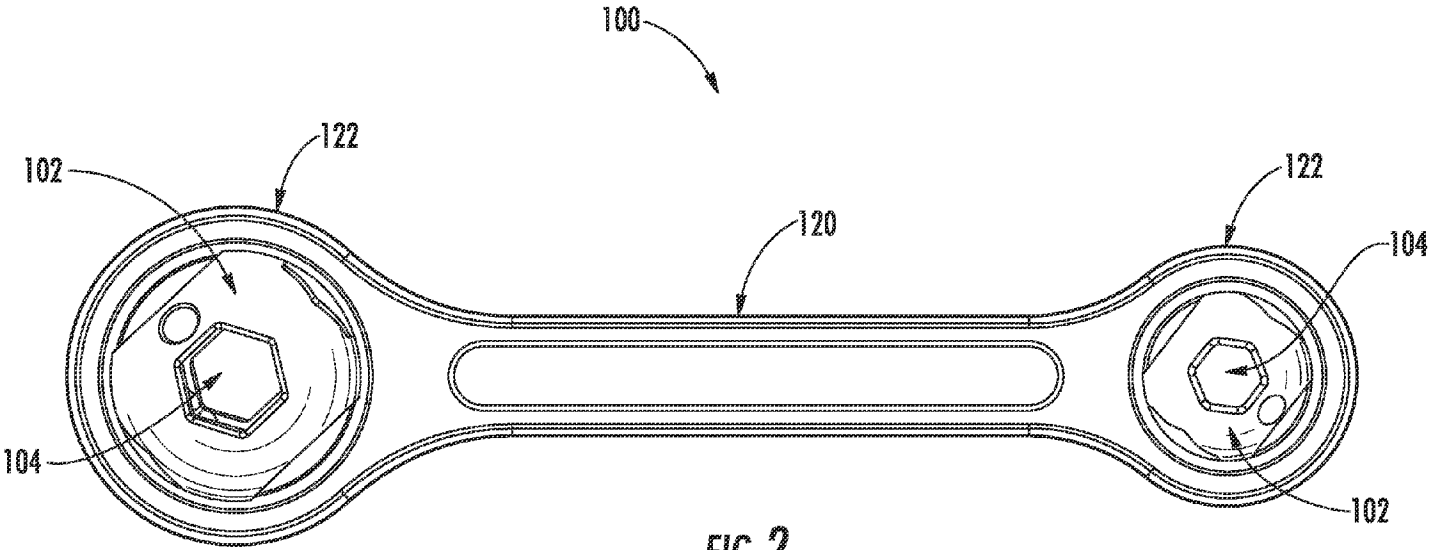
FIG. 2 is a top view of the preferred embodiment of the rotary ratchet wrench.
Figure 3:
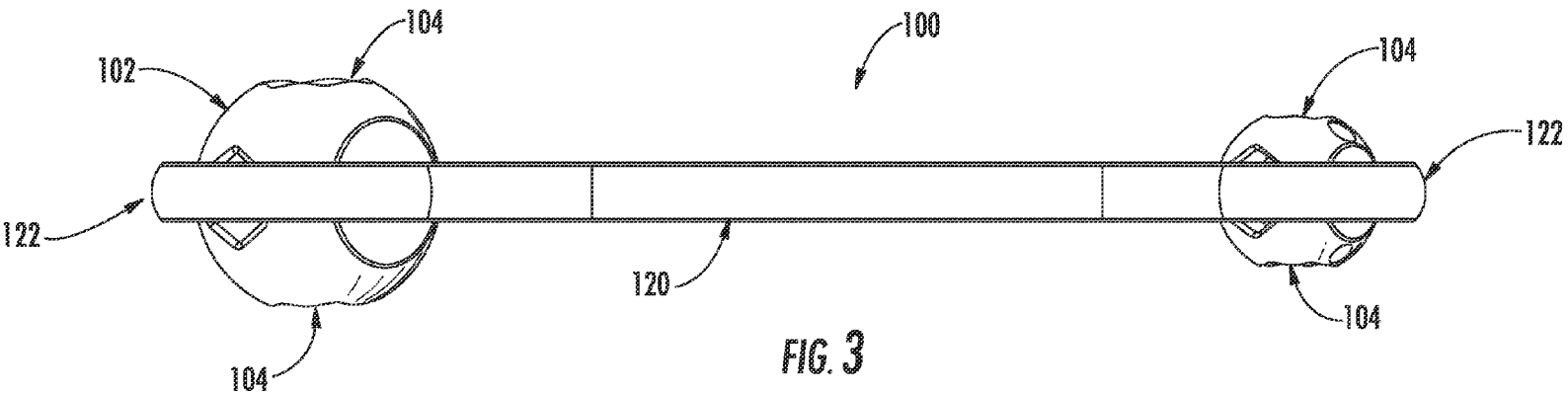
FIG. 3 is a side view of the preferred embodiment of the rotary ratchet wrench.

Referring to FIGS. 1-4, a preferred embodiment of a rotary ratchet wrench 100 is disclosed. The rotary ratchet wrench 100 contains an ergonomic handle 120 which terminates at opposed distal ends. An attachment end 122 is disposed at at least one of the distal ends of the handle 120. The attachment end 122 includes a ratcheting mechanism 200 (see FIG. 4) and a rotatable head 102 having a plurality of sockets 104. The rotatable head 102 advantageously provides an improvement over prior art box end wrenches by disposing a plurality sockets 104 on a single rotatable head 102. Further, the ratcheting mechanism 200 converts the multiple socket 104 rotary ratchet wrench 100 into a fast acting driving tool.

More specifically, the preferred embodiment discloses a substantially ball shaped rotatable head 102 having four sockets 104 equally spaced around the periphery of the ball shaped rotatable head 102. The sockets 104 are different standard and/or metric sizes to fit a wide variety of bolt heads or nuts. Although the preferred embodiment is a substantially ball shaped, other shapes may be employed without departing from the scope of this invention.

Figure 4:
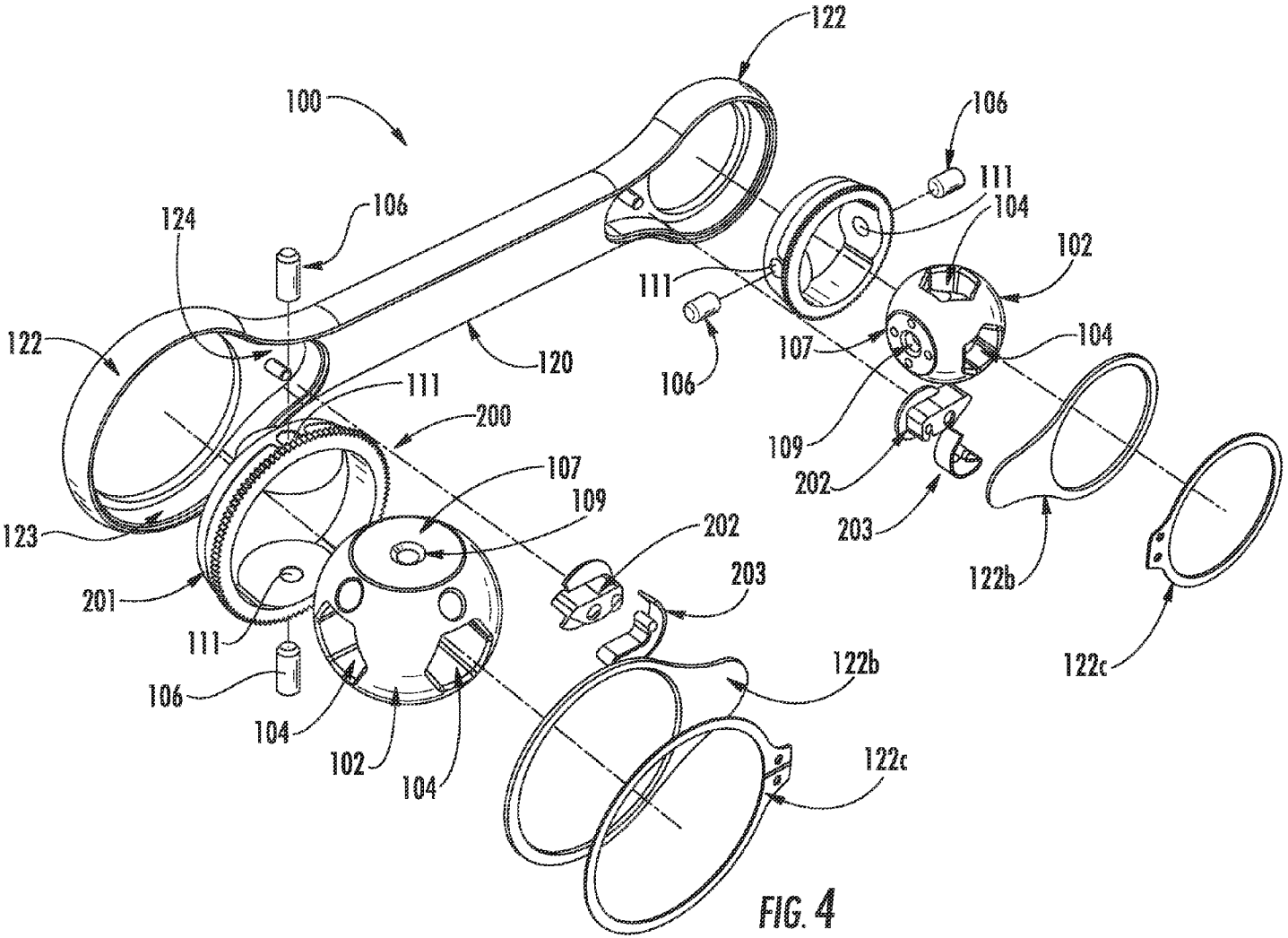
FIG. 4 is an exploded view of the preferred embodiment of the rotary ratchet wrench.

Illustrated in FIG. 4, the rotatable head 102 rotates on two pivot pins 106. The rotatable head 102 has two opposed flat faces 107 wherein a first receiving hole 109 is provided on the each of the respective faces 107. A pair of second receiving holes 111 is provided in the ratchet 200, and in the preferred embodiment, the second receiving holes 111 are formed on the inner circumference of a gear ring 201 (discussed more fully below). The pivot pins 106 are received in the holes 111 and holes 109 to combine the rotatable head 102 with the ratchet 200, thus the attachment end 122 allows the operator to rotate the rotatable head 102 between respective sockets 104.

As previously indicated, in the preferred embodiment, the rotary ratchet wrench 100 contains a ratcheting mechanism 200. The ratcheting mechanism 200 allows the user to reposition the rotary ratchet wrench 100 on the nut or bolt head for another stroke without having to completely remove the rotary ratchet wrench 100 from the nut or bolt head.

The ratcheting mechanism 200 includes, a gear ring 201 disposed in an annular groove 123 formed around an inner circumference of the attachment end 122 and a chamber 124 extending into the handle 120 wherein a ratchet tooth 202 is disposed. A cover 122*b* held in place by a snap-ring 122*c* covers the top of the attachment end 122 to cover the ratcheting mechanism 200 and complete the formation of the chamber 124. The ratcheting tooth 202 is biased by a spring 203 to engage the gear ring 201. Although a specific ratcheting mechanism 200 is disclosed as the preferred embodiment, any type of ratcheting mechanism 200 may be provided without departing from the scope of this invention.

In the preferred embodiment, the rotary ratchet 100 has a second attachment end 122 disposed at opposite end of the handle 120 at the second distal end, and having all the components and operating parts as previously described. However, one of the ends could contain any number of different tools without departing from the scope of the invention, for example a single size box end or open-ended wrench, a socket wrench, or a screw driver.

The invention herein disclosed advantageously combines a ratcheting mechanism 200 with multi-socket 104 box wrench 100. Although, ratcheting mechanisms 200 of some variety have been around for many years, never before has a ratcheting mechanism 200 been combined with a multiple socket 104 box wrench 100. In the preferred embodiment, two attachment ends 122 and two heads 102 contain a total of eight sockets 104 of different sizes. This advantageously consolidates eight hand tools into a single rotary ratchet wrench 100 with a ratcheting mechanism 200. In the decades that box end wrenches and ratcheting mechanisms have been around, no one has heretofore discovered a way to make the innovation herein disclosed.

Various aspects of any of the embodiments can be combined in different combinations than the ones shown to create new embodiments that fall within the scope of the appended claims.

While the present invention has been particularly shown and described with reference to exemplary embodiments thereof, it should be understood by those of ordinary skill in the art that various changes, substitutions and alterations can be made herein without departing from the scope of the invention as defined by appended claims and their equivalents. The invention can be better understood by reference to the following claims. For purpose of claim interpretation, the transitional phrases "including" and "having" are intended to be synonymous with the transitional phrase "comprising."

What is claimed is:

1. A hand tool, comprising:

a handle with a gripping portion and a distal end;

an attachment end disposed at the distal end;

a ratcheting body comprising a plurality of teeth combined with the attachment end and turnable with respect thereto around a first axis, the ratcheting body includes a first pair of aligned receiving holes apart from said teeth that extend completely through the ratcheting body;

at least one pivot pin defining a second axis perpendicular to the first axis; and a rotatable head having at least three sockets substantially equally spaced around a circumference of the rotatable head, wherein the rotatable head is rotatable with respect to the ratcheting body on the pivot pin 360 degrees around the second axis defined by the pivot pin, the rotatable head includes a second pair of receiving holes that extend completely through the rotatable head, such that the rotatable head is combined within the ratcheting body and the first and second pair of receiving holes are aligned to form a through hole that extends unobstructed through the ratcheting body, the pivot pin is received in the through hole to combine the rotatable head to the ratcheting body.

2. The hand tool of claim 1, wherein the attachment end is a box end.

3. The hand tool of claim 2, wherein the attachment end has a substantially circular outline.

4. The hand tool of claim 3, wherein the rotatable head is substantially ball shaped and having an imaginary line on the rotatable head's surface extending therearound about which is disposed four sockets equidistance apart.

5. The hand tool of claim 1, further comprising a second attachment end.

6. The hand tool of claim 1, wherein the rotatable head has four sockets, wherein the sockets oppose each other with an aperture extending between the respective sockets and the attachment end further comprises at least one tooth such that the tooth of the attachment end engages the teeth of the ratcheting body in a manner to provide selective 360 degree one-way rotation of the ratcheting body about the first axis.

7. A hand tool, comprising:

a handle with a gripping portion and a distal end;

an attachment end disposed at the distal end;

a ratcheting mechanism having a ratcheting body comprising a plurality of teeth and a ratcheting tooth combined with the attachment end, the ratcheting body turnable with respect to the attachment end around a first axis, the ratcheting body includes a first pair of aligned receiving holes apart from said teeth that extend into the ratcheting body unobstructed by the ratcheting tooth of the ratcheting mechanism; and a rotatable head combined with the ratcheting body and rotatable with respect to the ratcheting body around a second axis that is perpendicular to the first axis, the rotatable head includes a second pair of receiving holes that extend into the rotatable head, such that when the rotatable head is combined with the ratcheting body the first and second pair of receiving holes are aligned;

a pair of pivot pins defining the second axis are positioned in the first and the second receiving holes to combine the rotatable head to the ratcheting body, and the rotatable head is engaged with the ratcheting mechanism, wherein the rotatable head further comprises four sockets of different sizes spaced around a circumference of the rotatable head, and the rotatable head is rotatable 360 degrees around the second axis.

8. The hand tool of claim 7, wherein the attachment end further comprises an inner circumference having an annular groove extending therearound, and a chamber extending into the handle.

9. The hand tool of claim 8, wherein the ratcheting body further defines a gear ring disposed in the annular groove and the ratcheting tooth is disposed in the chamber and engages the gear ring.

10. A hand tool, comprising:

a handle with a gripping portion and two distal ends at opposite ends of the handle;

two attachment ends each respectively disposed at the distal ends;

two ratcheting bodies each comprising a plurality of teeth respectively combined with the attachment ends and turnable with respect to the attachment ends around a first axis, the ratcheting bodies each have a first pair of aligned receiving holes apart from said teeth that extend completely through the ratcheting body;

at least one pivot pin at each of the opposite ends of the handle defining a second axis perpendicular to the first axis; and two rotatable heads each have at least three sockets substantially equally spaced around a circumference of the rotatable head and a second pair of receiving holes that extend completely therethrough, such that each rotatable head is combined with the ratcheting body and the first and the second pair of receiving holes are aligned to form a through hole that extends unobstructed through the ratcheting body, the respective pivot pin is received in the through hole to combine the rotatable head to the ratcheting body, such that the rotatable heads are each rotatable with respect to the ratcheting body 360 degrees around the respective second axis that is defined by the respective pivot pin.

11. A hand tool, comprising:

a handle with a gripping portion and two distal ends at opposite ends of the handle;

two attachment ends each respectively disposed at the distal ends;

two ratcheting mechanisms each having a ratcheting body comprising a plurality of teeth and a ratcheting tooth, the two ratcheting mechanisms are respectively combined with the attachment ends, each ratcheting body is turnable with respect to the respective attachment end around respective first axes, each ratcheting body includes a first pair of aligned receiving holes apart from said teeth that extend completely through the ratcheting body unobstructed by the ratcheting tooth of the ratcheting mechanism; and two rotatable heads each having four sockets substantially equally spaced around a circumference of the rotatable head and a second pair of receiving holes that extend therein, such that when each rotatable head is combined with the respective ratcheting body the first and the second pair of receiving holes are aligned;

a pair of pivot pins are positioned in the first and the second receiving holes to combine the each rotatable head to the respective ratcheting body, and the rotatable head is engaged with the respective ratcheting mechanism.

12. The hand tool of claim 11, wherein each of the attachment ends further comprise an inner circumference having an annular groove extending therearound, and a chamber extending into the handle.

13. The hand tool of claim 12, wherein each of the ratcheting bodies defines a gear ring disposed in the annular groove and the ratcheting tooth is biasedly disposed in the chamber and engaging the gear ring.

14. The hand tool of claim 13, wherein each of the attachment ends has a substantially circular outline.

15. The hand tool of claim 14, wherein each of the rotatable heads is substantially ball shaped and having an imaginary line on the sockets surface extending therearound about which is disposed four sockets equidistance apart.

16. A ratcheting hand tool having an elongated handle intended for gripping in a user's hand, the ratcheting hand tool comprising;

a ratcheting mechanism having a turnable ring comprising a plurality of teeth;

a rounded head disposed at an end of the elongated handle and having an inner circumference defined by an aperture therethrough;

the aperture having a first axis extending therethrough;

the turnable ring includes a first pair of aligned receiving holes apart from said teeth positioned so as not to interfere with rotation of the turnable ring, the turnable ring is disposed in the inner circumference of the rounded head and selectively one-way rotatable in a clockwise or counter clockwise direction 360 degrees around the first axis;

at least one pivot pin combined with the turnable ring and defining a second axis; and a socket head positioned within the turnable ring and having at least three sockets substantially equally spaced around a circumference of the socket head, the socket head includes a second pair of receiving holes positioned, such that when the socket head is positioned within the turnable ring the first and second pair of receiving holes are aligned, the socket head is combined to the ring by the pivot pin positioned in the first and the second receiving holes so that the socket head is rotatable with respect to the turnable ring 360 degrees around the second axis defined by the pivot pin.

17. The ratcheting hand tool of claim 16, wherein the socket head has four sockets of different sizes positioned therearound.

18. The ratcheting hand tool of claim 17, wherein the rounded head has at least one tooth disposed therein such that the teeth of the turnable ring engages the tooth of the rounded head in a manner to provide selective 360 degree one-way rotation of the turnable ring in a clockwise or counter clockwise direction.

19. The ratcheting hand tool of claim 18, wherein the plurality of teeth are around an outer circumference of the turnable ring.

20. A hand tool for acting on a work piece, the hand tool comprising:

a handle with a gripping portion and an attachment end portion, the attachment end portion has a first aperture extending therethrough;

a ratcheting body comprising a plurality of teeth received in the first aperture and defining a second aperture, the ratcheting body has a first pair of aligned receiving holes apart from said teeth that extend completely through the ratcheting body, the ratcheting body being selectively one-way turnable with respect to the attachment end portion in a ratcheting action around a first axis, wherein the first axis is alignable with the work piece to turn the work piece; and a rotatable head including a second pair of receiving holes, the rotatable head is positioned in the second aperture and rotatably combined to the ratcheting body to rotate with respect to the ratcheting body in the second aperture around a second axis that is perpendicular to the first axis, a pair of pivot pins received through the first and second pair of receiving holes to combine the rotatable head to the ratcheting body, wherein the second axis is defined by the pins and the rotatable head rotates on the second axis, which second axis is fixed with respect to the ratcheting body, wherein the rotatable head has at least three drive members substantially equally spaced around a circumference of the rotatable head, the rotatable head operable for selection between drive members and the rotatable head is rotatable 360 degrees in either a clockwise or a counter-clockwise direction around the second axis until the desired drive member is coaxial with an axis for the work piece.

21. The hand tool of claim 20, wherein the ratcheting body defines a gear ring and the teeth are disposed around an outer circumference of the gear ring.

22. The hand tool of claim 21, and further comprising a chamber in the handle and a biased ratchet tooth is disposed in the chamber of the handle, the tooth engaging the gear ring.

23. The hand tool of claim 22, wherein the rotatable head has four drive member.

24. The hand tool of claim 23, wherein the drive members are sockets.

25. The hand tool of claim 24, wherein the sockets oppose each other with an aperture extending between the respective sockets.

26. The hand tool of claim 25, wherein the second axis maintains alignment with a diameter of the first aperture.

27. The hand tool of claim 26, wherein a selected drive member has a third axis that is aligned with the work piece to turn the work piece.

28. The hand tool of claim 27, wherein the first axis and the third axis are aligned to turn the work piece.

29. The hand tool of claim 20, wherein the rotatable head has four drive members.

30. The hand tool of claim 29, wherein the drive members are sockets.

31. The hand tool of claim 30, wherein the sockets oppose each other with an aperture extending between the respective sockets.

32. The hand tool of claim 30, and further comprising a second attachment end portion on an opposite end of the first attachment end portion and having a third aperture extending therethrough a second ratcheting body defining a fourth aperture, the second ratcheting body is positioned in the third aperture of the second attachment end portion and selectively one-way turnable with respect to the second attachment end portion in a ratcheting action around a third axis, wherein the third axis is alignable with the work piece to turn the work piece; and a second substantially ball shaped rotatable head positioned in the fourth aperture and rotatably combined to the second ratcheting body to rotate with respect to the second ratcheting body in the fourth aperture around a fourth axis that is perpendicular to the third axis, wherein the second rotatable head has at least three drive members substantially equally spaced around a circumference of the second rotatable head, the second rotatable head operable for selection between drive members by rotating the second rotatable head 360 degrees in either a clockwise or a counter-clockwise direction around the fourth axis until the desired drive member is coaxial with an axis for the work piece.

* * * * *